US010496013B2

(12) United States Patent
Kubota et al.

(10) Patent No.: US 10,496,013 B2
(45) Date of Patent: Dec. 3, 2019

(54) DEVELOPING DEVICE, PROCESS CARTRIDGE, AND IMAGE FORMING APPARATUS

(71) Applicants: Tomohiro Kubota, Kanagawa (JP); Naoki Nakatake, Tokyo (JP); Minoru Toyoda, Kanagawa (JP); Kazuki Matsumoto, Kanagawa (JP); Kenji Nakamura, Kanagawa (JP)

(72) Inventors: Tomohiro Kubota, Kanagawa (JP); Naoki Nakatake, Tokyo (JP); Minoru Toyoda, Kanagawa (JP); Kazuki Matsumoto, Kanagawa (JP); Kenji Nakamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/968,014

(22) Filed: May 1, 2018

(65) Prior Publication Data

US 2018/0364620 A1 Dec. 20, 2018

(30) Foreign Application Priority Data

Jun. 15, 2017 (JP) ..... 2017-117573

(51) Int. Cl.
*G03G 15/08* (2006.01)

(52) U.S. Cl.
CPC . *G03G 15/0893* (2013.01); *G03G 2215/0838* (2013.01)

(58) Field of Classification Search
CPC ... G03G 2215/0833; G03G 2215/0847; G03G 2215/0811; G03G 2215/0813
See application file for complete search history.

(56) References Cited

U.S. PATENT DOCUMENTS 5,963,766 A * 10/1999 Okuno ..... G03G 15/0822 399/254
7,493,068 B2 * 2/2009 Tatsumi ..... G03G 15/0893 399/254

(Continued)

FOREIGN PATENT DOCUMENTS

JP 4-106570 4/1992
JP 2008-107427 5/2008

(Continued)

*Primary Examiner* — Clayton E. LaBalle
*Assistant Examiner* — Leon W Rhodes, Jr.
(74) *Attorney, Agent, or Firm* — Harness, Dickey & Pierce, P.L.C.

(57) ABSTRACT

A developing device is provided which includes: a developing roller in contact with or facing an image bearer; a supply roller to supply toner to the developing roller; a casing; a first conveyer disposed within the casing and above the supply roller to supply toner stored in the developing device to the supply roller, while forming a first conveyance path; a second conveyer disposed within the casing with an upper end thereof positioned below that of the first conveyer, while forming a second conveyance path forming a toner circulation path together with the first conveyance path; a partition wall separating the first conveyance path and the second conveyance path in a longitudinal direction within a range excluding both longitudinal end portions; and a toner supply port, at a ceiling of the casing above the second conveyance path, through which toner is supplied to an inside of the developing device.

13 Claims, 4 Drawing Sheets

(56) References Cited

U.S. PATENT DOCUMENTS

| | | | | |
|---|---|---|---|---|
| 8,045,892 | B2 * | 10/2011 | Sakata | G03G 15/0877 399/254 |
| 8,660,468 | B2 * | 2/2014 | Matsumoto | G03G 15/0822 399/260 |
| 9,261,816 | B2 * | 2/2016 | Sakaya | G03G 15/0862 |
| 2008/0145094 | A1 | 6/2008 | Nakamura et al. | |
| 2011/0188896 | A1 | 8/2011 | Sakaya et al. | |
| 2012/0189326 | A1 | 7/2012 | Yoshida et al. | |
| 2012/0189327 | A1 | 7/2012 | Kubota et al. | |
| 2012/0189350 | A1 | 7/2012 | Kubota et al. | |
| 2013/0028638 | A1 | 1/2013 | Tsuritani et al. | |
| 2013/0183065 | A1 | 7/2013 | Nakamura et al. | |
| 2013/0236217 | A1 | 9/2013 | Nagatomo et al. | |
| 2013/0259532 | A1 | 10/2013 | Kubota et al. | |
| 2013/0266347 | A1 | 10/2013 | Kubota et al. | |
| 2014/0112687 | A1 | 4/2014 | Ohmura et al. | |
| 2014/0294449 | A1 | 10/2014 | Kubota et al. | |
| 2014/0356004 | A1 | 12/2014 | Tsuritani et al. | |
| 2015/0125167 | A1 | 5/2015 | Yamaguchi et al. | |
| 2016/0004208 | A1 | 1/2016 | Kubota et al. | |
| 2016/0139540 | A1 | 5/2016 | Kubota et al. | |
| 2016/0299455 | A1 * | 10/2016 | Tsuritani | G03G 15/0891 |
| 2017/0146925 | A1 | 5/2017 | Tsuji et al. | |
| 2017/0248870 | A1 | 8/2017 | Kubota et al. | |

FOREIGN PATENT DOCUMENTS

| | | |
|---|---|---|
| JP | 2014-102495 | 6/2014 |
| JP | 2015-025999 | 2/2015 |

* cited by examiner

DEVELOPING DEVICE, PROCESS CARTRIDGE, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2017-117573, filed on Jun. 15, 2017, in the Japan Patent Office, the entire disclosure of which is hereby incorporated by reference herein.

BACKGROUND

Technical Field

The present disclosure relates to a developing device, a process cartridge, and an image forming apparatus.

Description of the Related Art

As a developing device for use in an image forming apparatus such as copier and printer, a developing device employing a one-component developing method is widely used that performs a developing process using toner serving as a one-component developer.

For example, a developing device including a developing roller (developer bearer), a supply roller (developer supplier), a doctor blade (developer regulator), and two conveying screws (conveyers) is known. In this developing device, toner (one-component developer) is stored. One of the conveying screws (first conveyer) is disposed facing the supply roller and the developing roller, and the other one of the conveying screws (second conveyer) is disposed facing the developing roller in a substantially horizontal direction via the other conveying screw (first conveyer) and the supply roller. The two conveying screws form a circulation path for toner in a longitudinal direction.

The toner stored in the developing device is circulated within the circulation path formed by the two conveying screws while being stir-mixed with toner supplied through a toner supply port to the inside of the developing device.

The toner is supplied to the supply roller as being conveyed in a longitudinal direction by one of the conveying screws (first conveyer), and is further supplied onto the developing roller by the supply roller that is in abrasive contact with the developing roller. The toner borne on the developing roller is formed into a thin layer by the doctor blade. In a region (developing region) where the developing roller faces a photoconductor drum (image bearer), the toner having been formed into a thin layer on the developing roller is supplied to a latent image on the photoconductor drum, thus forming a toner image on the photoconductor drum.

SUMMARY

In accordance with some embodiments of the present invention, a developing device for developing a latent image formed on a surface of an image bearer into a toner image is provided. The developing device includes a developing roller, a supply roller, a casing, a first conveyer, a second conveyer, a partition wall, and a toner supply port. The developing roller is in contact with or facing the image bearer. The supply roller is configured to supply toner to the developing roller. The first conveyer is disposed within the casing and above the supply roller and configured to supply toner stored in the developing device to the supply roller, while forming a first conveyance path. The second conveyer is disposed within the casing with an upper end thereof positioned below an upper end of the first conveyer, while forming a second conveyance path forming a toner circulation path together with the first conveyance path. The partition wall separates the first conveyance path and the second conveyance path in a longitudinal direction within a range excluding both longitudinal end portions. The toner supply port is disposed at a ceiling of the casing above the second conveyance path, through which toner is supplied to an inside of the developing device.

In accordance with some embodiments of the present invention, a process cartridge detachably mountable on an image forming apparatus is provided. The process cartridge includes an image bearer and the above-described developing device.

In accordance with some embodiments of the present invention, an image forming apparatus is provided. The image forming apparatus includes an image bearer and the above-described developing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
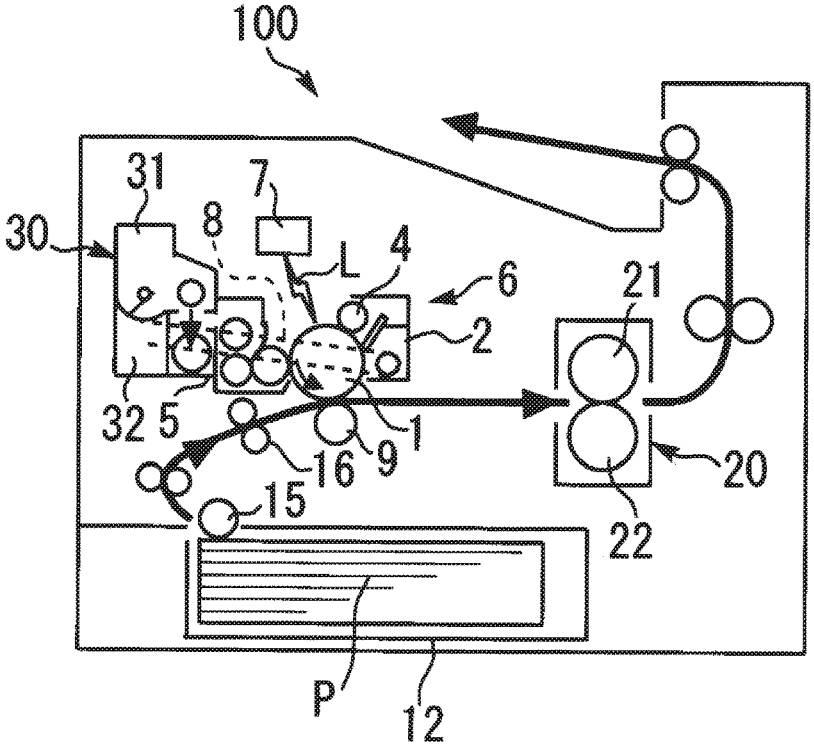
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a" "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In the above-described conventional developing device employing a one-component developing method, it is likely that the internal pressure of the developing device increases. As a result, the amount of toner supplied through the toner supply port to the inside of the developing device becomes unstable, or toner cannot smoothly and stably circulate within the circulation path in the developing device. Once such a problem occurs, a toner image formed on the photoconductor drum (image bearer) may be blurred or the image density thereof may be non-uniform.

In accordance with some embodiments of the present invention, a developing device is provided that is less likely to increase the internal pressure.

Overall configuration and operation of an image forming apparatus 100 are described below with reference to FIG. 1.

Referring to FIG. 1, the image forming apparatus 100, serving as a printer, includes: a photoconductor drum 1 on the surface of which a toner image is to be formed; a process cartridge 6 integrating a charging roller 4, a developing device 5, and a cleaner 2; an irradiator (writing unit) 7 to irradiate the photoconductor drum 1 with light L containing image information having been input from an input device such as a personal computer.

The image forming apparatus 100 further includes: a waste toner conveyer 8 to convey untransferred toner particles collected by the cleaner 2 to a waste toner collector 32 as waste toner particles; a transfer roller 9 to transfer a toner image borne on the surface of the photoconductor drum 1 onto a sheet P fed to a transfer nip (transfer position); and a sheet feeder (sheet tray) 12 storing the sheet P such as paper sheets.

The image forming apparatus 100 further includes: a registration roller (timing roller) 16 to feed the sheet P toward the transfer nip where the photoconductor drum 1 contacts the transfer roller 9; and a fixing device 20 to fix an unfixed image on the sheet P, including a fixing roller 21 and a pressure roller 22.

The image forming apparatus 100 further includes and a toner container 30 integrating a toner storage 31 storing fresh toner particles and the waste toner collector 32 collecting waste toner particles.

Around the photoconductor drum 1, the charging roller 4, the developing device 5, and the cleaner 2 are disposed. The above members (i.e., the photoconductor drum 1, the charging roller 4, the developing device 5, and the cleaner 2) are integrated as the process cartridge 6. The process cartridge 6 is detachably (replaceably) mounted on the body of the image forming apparatus 100. At the time of periodic replacement or maintenance, the process cartridge 6 is detached from the apparatus body of the image forming apparatus 100 and replaced with a new one (or the one having subjected to maintenance).

The toner container 30 is detachably (replaceably) mounted on the process cartridge 6 (developing device 5). In the toner storage 31 in the toner container 30, toner (one-component developer) is stored. The toner is supplied from the toner container 30 (toner storage 31) to the inside of the developing device 5. As the toner storage 31 becomes empty, the toner container 30 is detached from the body of the image forming apparatus 100, along with the waste toner collector 32 having collected waste toner particles, and replaced with a new one.

A normal image forming operation of the image forming apparatus 100 is described below with reference to FIG. 1.

As image information is transmitted from an input device, such as a personal computer, to the irradiator 7 in the image forming apparatus 100, the irradiator 7 irradiates a surface of the photoconductor drum 1 with laser light L based on the image information.

The photoconductor drum 1 is driven to rotate in a direction indicated by arrow in FIG. 1 (i.e., counterclockwise direction) by a driving motor disposed in the image forming apparatus 100. The surface of the photoconductor drum 1 is uniformly charged at a position where the photoconductor drum 1 faces the charging roller 4 ("charging process"), and a tribo-electric potential (about −900 V) is formed on the photoconductor drum 1. The charged surface of the photoconductor drum 1 thereafter reaches an irradiation position of the light L. The irradiated portion of the photoconductor drum 1 with the light L has a latent image potential (about 0 to −100 V) and an electrostatic latent image is formed on the surface of the photoconductor drum 1 ("irradiation process").

The surface of the photoconductor drum 1 having the electrostatic latent image thereon thereafter reaches a position where the photoconductor drum 1 faces the developing device 5. The developing device 5 supplies toner onto the photoconductor drum 1 and the latent image formed on the photoconductor drum 1 is thereby developed into a toner image ("developing process").

The surface of the photoconductor drum 1 having the toner image thereon thereafter reaches a transfer nip (transfer position) formed between the photoconductor drum 1 and the transfer roller 9. In the transfer nip, a transfer bias (having an opposite polarity to toner) is applied from a power source to the transfer roller 9, and the toner image formed on the photoconductor drum 1 is thereby transferred onto the sheet P fed by the registration roller 16 ("transfer process").

The surface of the photoconductor drum 1 having the transferred toner image thereon thereafter reaches a position where the photoconductor drum 1 faces the cleaner 2. At this position, untransferred toner particles remaining on the photoconductor drum 1 are mechanically removed by a cleaning blade 2*a* (illustrated in FIG. 2) and collected in the cleaner 2 ("cleaning process").

A series of image forming processes conducted on the photoconductor drum 1 is thus completed.

The untransferred toner particles collected in the cleaner 2 are discharged from the cleaner 2 by a waste toner conveying screw 2*b* (illustrated in FIG. 2), conveyed by the waste toner conveyer 8, and thereafter collected in the waste toner collector 32 as waster toner.

On the other hand, the sheet P is fed to the transfer nip formed between the photoconductor drum 1 and the transfer roller 9 in the following manner.

First, the sheet P stored at the top in the sheet feeder 12 is fed toward a conveyance path by a feed roller 15.

The sheet P thereafter reaches the position of the registration roller 16. The sheet P is fed from the position of the registration roller 16 to the transfer nip (i.e., contact position of the transfer roller 9 with the photoconductor drum 1) in synchronization with an entry of the toner image formed on the photoconductor drum 1 into the transfer nip.

After the transfer process, the sheet P passes through the transfer nip (i.e., position of the transfer roller 9) and reaches the fixing device 20 via a conveyance path. In the fixing device 20, the sheet P is interposed between the fixing roller 21 and the pressure roller 22. The toner image is fixed on the sheet P by heat applied from the fixing roller 21 and pressure applied from both the fixing roller 21 and the pressure roller 22. The sheet P having the fixed toner image thereon is discharged from the fixing nip formed between the fixing roller 21 and the pressure roller 22, ejected from the body of the image forming apparatus 100, and stacked on an output tray.

A series of image forming processes is thus completed.

The process cartridge 6 is described in detail below with reference to FIG. 2.

Figure 2:
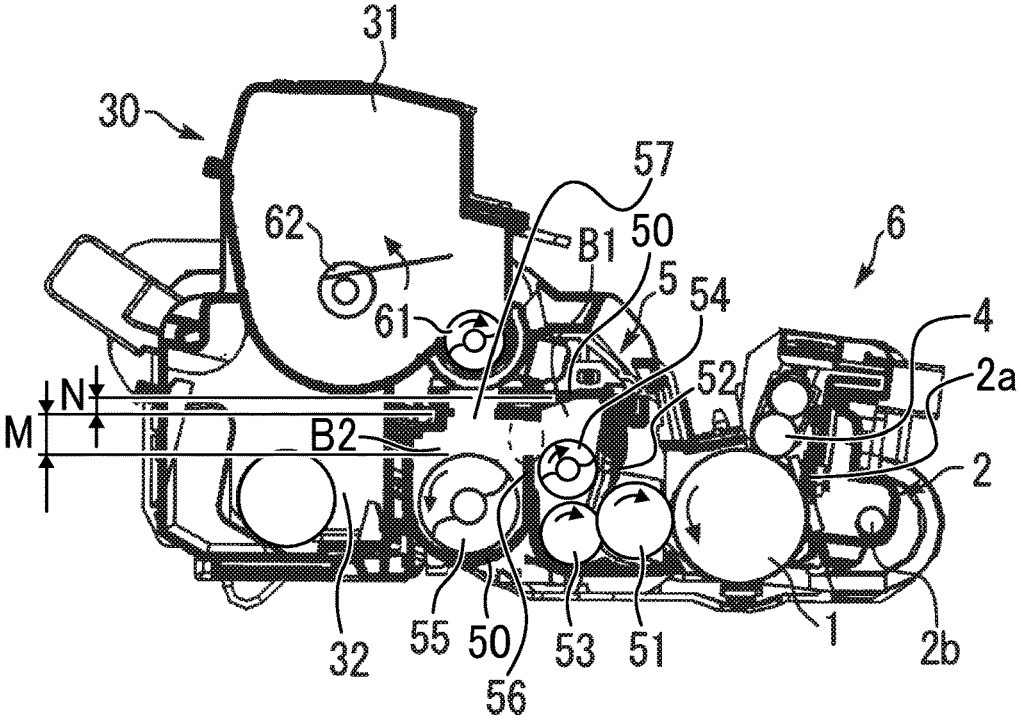
FIG. 2 is a schematic view of a process cartridge and a toner container according to an embodiment of the present invention.

Referring to FIG. 2, the process cartridge 6 includes the photoconductor drum 1 serving as an image bearer, the charging roller 4 (charger), the developing device 5, and the cleaner 2.

The photoconductor drum 1 is a negatively-chargeable organic photoconductor, and is driven to rotate counterclockwise in FIG. 2 by a drive motor disposed in the body of the image forming apparatus 100.

The charging roller 4 (charger) is an elastic roller including a cored bar and a medium-resistance foamed urethane layer, formed on the cored bar, containing urethane resin, carbon black serving as conductive particles, a sulfuration agent, and a foaming agent. The medium-resistance layer of the charging roller 4 may be made of a rubber material, such as urethane, ethylene-propylene-diene polyethylene (EPDM), butadiene acrylonitrile rubber (NBR), silicone rubber, and isoprene rubber, in which a conductive substance (e.g., carbon black and metal oxide) is dispersed for adjusting resistance, or a foamed product thereof. In the present embodiment, the photoconductor drum 1 is disposed in contact with the charging roller 4. Alternatively, the photoconductor drum 1 may also be disposed so as not to contact the charging roller 4.

The cleaner 2 is equipped with the cleaning blade 2*a* that slidably contacts the photoconductor drum 1 to mechanically remove and collect untransferred toner particles remaining on the photoconductor drum 1. The cleaning blade 2*a* is a substantially-plate-like member formed of an elastic material such as urethane rubber. The cleaning blade 2*a* is in contact with the photoconductor drum 1 with a certain pressure forming a certain angle therebetween.

The developing device 5 includes a developing roller 51 serving as a developer bearer. The developing roller 51 is pressed against the photoconductor drum 1 with a certain pressure, and a developing region is formed within a developing nip formed between the photoconductor drum 1 and the developing roller 51. In the developing device 5, toner (i.e., non-magnetic or magnetic one component developer) is stored. The developing device 5 develops an electrostatic latent image formed on the photoconductor drum 1 into a toner image.

The developing device 5 is described in detail below with reference to FIG. 2.

Referring to FIG. 2, the developing device 5 employs a contact one-component developing method. The developing device 5 is integrated with other image forming members, i.e., the photoconductor drum 1, the cleaner 2, and the charging roller 4, as the process cartridge 6. The process cartridge 6 is detachably (replaceably) mounted on the body of the image forming apparatus 100. The toner container 30 is detachably (replaceably) mounted on the developing device 5 (process cartridge 6) mounted on the body of the image forming apparatus 100. By opening the body cover, the toner container 30 alone can be separated from the developing device 5 (process cartridge 6) and replaced with a new one, or the developing device 5 (process cartridge 6) together with the toner container 30 can be integrally replaced with new ones.

Replacement of the toner container 30 is conducted at the time when the stored toner has been consumed. Replacement of the developing device 5 (process cartridge 6) is conducted at the time when constitutional components (e.g., the developing roller 51 and the photoconductor drum 1) have reached the end of their lifespans and the stored toner has been consumed. Accordingly, the toner container 30 alone is to be independently replaced, and the developing device 5 (process cartridge 6) is to be replaced along with the toner container 30 (with the toner container 30 mounted thereon).

The developing device 5 includes: the developing roller 51 serving as a developer bearer; a supply roller 53 serving as a developer supplier; a doctor blade 52 serving as a developer regulator; a first conveying screw 54 and a second conveying screw 55 each serving as a conveyer; a partition wall 56 to separate a first conveyance path B1 formed by the first conveying screw 54 and a second conveyance path B2 formed by the second conveying screw 55; a toner supply port 57 through which toner is supplied from the toner container 30; and a casing 50 storing the first conveying screw 54 and the second conveying screw 55.

The developing roller 51 (developer bearer) is disposed in contact with the photoconductor drum 1. The developing roller 51 rotates clockwise in FIG. 2 while bearing toner to supply the toner to an electrostatic latent image formed on the photoconductor drum 1. The developing roller 51 may include a rotary shaft (cored bar) made of a conductive metallic material (e.g., stainless steel) and a roller part made of an elastic material formed on the rotary shaft. In the present embodiment, the roller part of the developing roller 51 includes: an elastic layer made of a rubber material having an ASKER hardness of 50 degrees or less and an electrical resistance of $10^3$ to $10^{10}\Omega$; and a surface coating layer having a surface roughness Ra of about 0.2 to 2.0 μm.

The supply roller 53 (developer supplier) is disposed in abrasive contact with the developing roller 51, and supplies toner to the developing roller 51. The supply roller 53 may include a cored bar and a conductive foamed polyurethane layer (having an electrical resistance of about $10^3$ to $10^{14}\Omega$) laminated on the cored bar. The supply roller 53 has another function of removing toner particles remaining on the developing roller 51 without being supplied to the developing region formed between the developing roller 51 and the photoconductor drum 1 in the developing process.

The doctor blade 52 (developer regulator) is disposed such that the leading end thereof contacts the outer circumferential surface of the developing roller 51 with a pressure of about 10 to 100 N/m forming a certain angle therebetween, so that the amount of developer borne on the developing roller 51 is regulated. In other words, the doctor blade 52 contacts the developing roller 51 so as to form the toner borne on the developing roller 51 into a thin layer. The doctor blade 52 may be a thin plate-like member made of a metallic material such as stainless steel.

The developing roller 51, supply roller 53, and doctor blade 52 are applied with a certain amount of voltage from power supply. Thus, movement of toner is promoted on the developing roller 51. In the present embodiment, an alternating voltage (i.e., a square wave having an AC frequency of about 500 to 1,0001 Hz, a peak-to-peak voltage of about 500 to 3,000 V, and an application time duty of about 30% to 70%) is applied to the developing roller 51 so that toner moves back and forth between the developing roller 51 and the photoconductor drum 1 within the developing region.

In the present embodiment, the developing roller 51 is applied with an alternating voltage. Alternatively, the developing roller 51 may be applied with a direct-current voltage of about −100 to −500 V.

The first and second conveying screws 54 and 55 (conveyers) convey toner stored in the developing device 5 in a longitudinal direction (i.e., a direction perpendicular to the surface of the paper on which FIG. 2 in drawn, coincident with a rotational axis direction), thereby forming a circulation path for toner.

Figure 3:
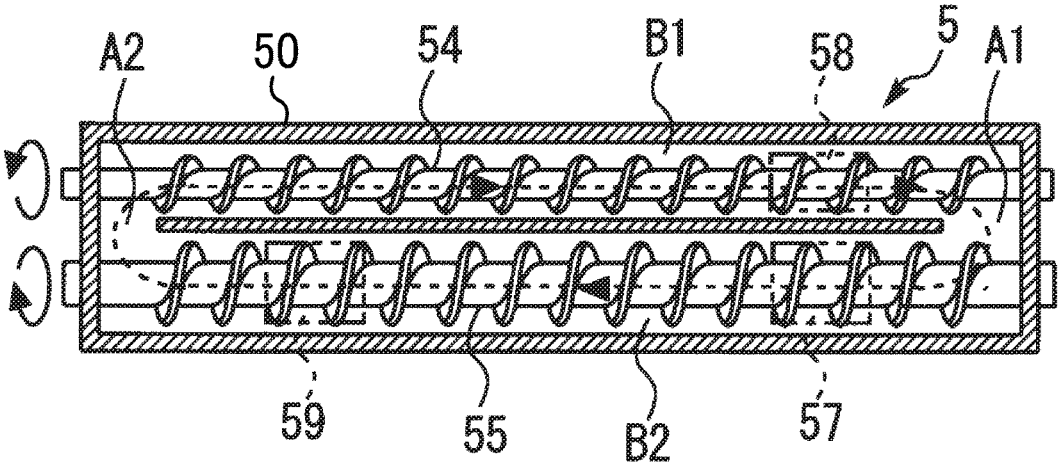
FIG. 3 is a top view of a circulation path, in a longitudinal direction, formed in a developing device according to an embodiment of the present invention.

The first conveying screw 54 is disposed above the supply roller 53, and supplies toner to the supply roller 53 by horizontally conveying toner stored in the developing device 5 in the longitudinal direction (from left to right in FIG. 3).

The second conveying screw 55 is disposed facing the developing roller 51 in a substantially horizontal direction via the supply roller 53 and the first conveying screw 54. The second conveying screw 55 conveys toner stored in the developing device 5 in the longitudinal direction (from right to left in FIG. 3) and forms the circulation path for toner together with the first conveying screw 54. Referring to FIG. 3, the second conveying screw 55 conveys toner which has been conveyed from a downstream end portion of the first conveyance path B1, formed by the first conveying screw 54, through a first communication part A1 to an upstream end portion of the first conveyance path B1 through a second communication part A2, thereby circulating the toner.

Similar to the developing roller 51 and the photoconductor drum 1, the first and second conveying screws 54 and 55 are disposed such that the rotational axes thereof are substantially horizontal. Each of the first and second conveying screws 54 and 55 includes a shaft and a screw part spirally wound around the shaft.

In the present embodiment, the second conveying screw 55 is disposed facing the first conveying screw 54 via the partition wall 56 at a position obliquely below the first conveying screw 54. Details are described later.

The first conveyance path B1 formed by the first conveying screw 54 and the second conveyance path B2 formed by the second conveying screw 55 are separated by the partition wall 56 in the longitudinal direction within a range excluding both longitudinal end portions (where the first communication part A1 and the second communication part A2 are formed).

More specifically, as illustrated in FIG. 3, a downstream end portion of the second conveyance path B2 and an upstream end portion of the first conveyance path B1 are communicated via the second communication part A2. Toner having reached the downstream end portion of the second conveyance path B2 formed by the second conveying screw 55 passes through the second communication part A2 and reaches the upstream end portion of the first conveyance path B1.

A downstream end portion of the first conveyance path B1 and an upstream end portion of the second conveyance path B2 are communicated via the first communication part A1. Toner having not been supplied to the supply roller 53 (or having been collected by the supply roller 53) and reached the downstream end portion of the first conveyance path B1 passes through the first communication part A1 and reaches the upstream end portion of the second conveyance path B2.

Referring to FIG. 2, the toner supply port 57, through which toner is supplied to the inside of the developing device 5, is formed at a ceiling of the casing 50 above the second conveyance path B2. The toner supply port 57 is communicated with a toner discharge port of the toner container 30 (toner storage 31). Fresh toner particles discharged through the toner discharge port of the toner container 30 (toner storage 31) fall by their own weight toward the second conveyance path B2 through the toner supply port 57. The fresh toner particles fallen by their own weight to the second conveyance path B2 are, along with toner particles stored in the developing device 5, conveyed within the circulation path while being stir-mixed by the first and second conveying screws 54 and 55.

In the present embodiment, the toner supply port 57 is disposed on an upstream side of the second conveyance path B2. Due to this configuration, fresh toner particles fallen by their own weight to the second conveyance path B2 are conveyed to the first conveyance path B1 after being stir-mixed with existing toner particles by the second conveying screw 55 for a sufficient period of time. Thus, toner supplied from the first conveyance path B1 to the supply roller 53 by the first conveying screw 54 involves the mixture of the exiting toner particles and the fresh toner particles having been sufficiently mixed to have stable properties, which provides stable image quality.

Each of the developing roller 51, supply roller 53, first conveying screw 54, and second conveying screw 55 has a gear on the shaft, forming a gear train including idle gears. A drive motor (driver) inputs a drive force to the gear train to drive the developing roller 51, supply roller 53, first conveying screw 54, and second conveying screw 55 to rotate in directions indicated by respective arrows in FIG. 2.

Referring to FIG. 2, the toner storage 31 of the toner container 30 includes an agitator 62 and a container-side conveying screw 61.

The agitator 62 includes a rotary shaft and a thin-plate-like flexible member attached to the rotary shaft. The agitator 62 rotates counterclockwise in FIG. 2 to convey fresh toner particles stored in the toner storage 31 toward a conveyance path formed by the container-side conveying screw 61.

The container-side conveying screw 61 conveys toner particles stored in the toner container 30 toward the toner discharge port disposed at one longitudinal end portion thereof.

The toner discharge port of the toner storage 31 (toner container 30) is disposed at one longitudinal end portion of the conveyance path formed by the container-side conveying screw 61. As the container-side conveying screw 61 is driven to rotate, toner particles are discharged through the toner discharge port. The discharged toner particles further fall by their own weight through the toner supply port 57 to an upstream side of the second conveyance path B2 in the developing device 5.

Toner supply from the toner storage 31 to the developing device 5 is appropriately performed based on a detection result made by a toner detection sensor disposed in the developing device 5. Specifically, as the toner detection sensor detects a status in which toner stored in the developing device 5 has not reached a predetermined amount (predetermined height), the container-side conveying screw 61 is driven to rotate for a predetermined period of time. As the toner detection sensor detects a status in which the toner has reached a predetermined amount (predetermined height), rotary drive of the container-side conveying screw 61 is stopped. The toner detection sensor may be either a photosensor that optically detects presence and absence of toner or a piezoelectric sensor that detects presence and absence of toner by pressure.

The developing device 5 having the above-described configuration operates as follows.

Fresh toner particles supplied from the toner container 30 (toner storage 31) to the second conveyance path B2 through the toner supply port 57 are, along with toner particles circulating within the developing device 5, supplied to the first conveyance path B1 as being stir-mixed by the second conveying screw 55. A part of the toner particles having been conveyed to the first conveyance path B1 is supplied to the supply roller 53 and borne thereon as being conveyed by the first conveying screw 54. The toner particles borne on the supply roller 53 are triboelectrically charged at a position where the supply roller 53 presses against the developing roller 51, and thereafter moved onto the developing roller 51 and borne thereon. The toner particles borne on the developing roller 51 are, at a position where the developing roller 51 contacts the doctor blade 52, formed into a thin layer and triboelectrically charged uniformly. The toner particles thereafter reach a developing region where the developing roller 51 faces the photoconductor drum 1. At this position, the toner particles are adsorbed to a latent image formed on the photoconductor drum 1 due to an action of an electric field formed in the developing region (i.e. developing electric field).

The characteristic configuration and operation of the developing device 5 (process cartridge 6) according to the present embodiment are described in detail below.

Referring to FIG. 2, in the developing device 5 according to the present embodiment, the upper end of the second conveying screw 55 is positioned below the upper end of the first conveying screw 54.

Specifically, in the present embodiment, the outer diameter (screw diameter) of the second conveying screw 55 is greater than the outer diameter (screw diameter) of the first conveying screw 54. In addition, the rotational axis (rotational center) of the second conveying screw 55 is positioned below the rotational axis (rotational center) of the first conveying screw 54. The upper end of the screw part of the second conveying screw 55 is positioned below the upper end of the first conveying screw 54. The lower end of the screw part of the second conveying screw 55 is positioned above or the same level as the lower end of the developing roller 51 and the supply roller 53.

By positioning the second conveying screw 55 below the first conveying screw 54, a distance M between the ceiling of the casing 50 having the toner supply port 57 and the second conveying screw 55 can be made sufficiently large.

Figure 4:
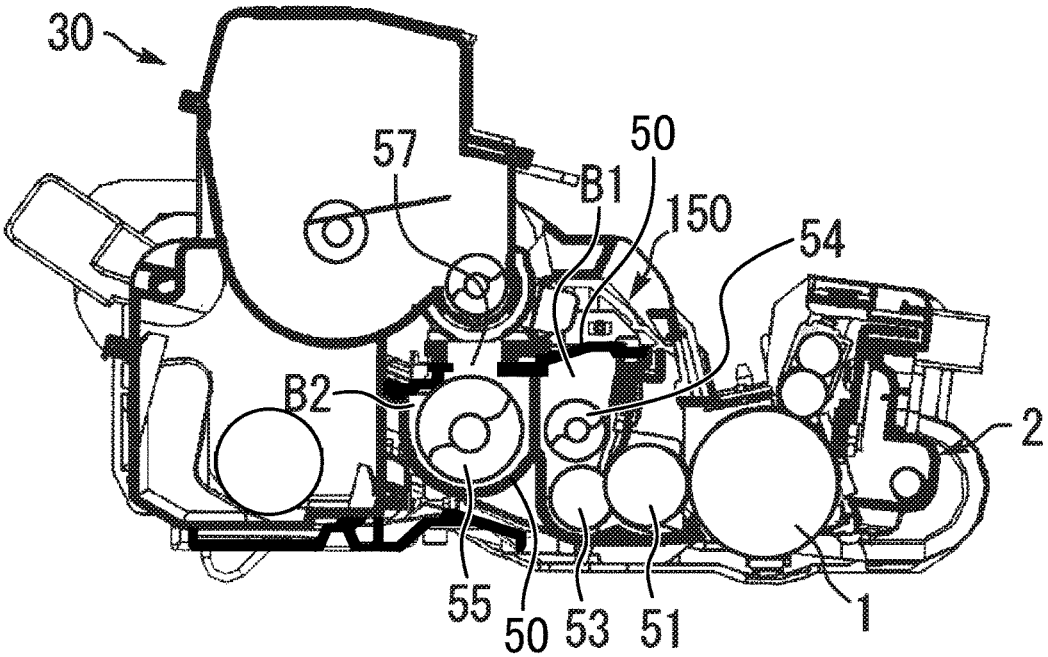
FIG. 4 RELATED ART
FIG. 4 is a schematic view of a process cartridge and a toner container according to a comparative example.

Referring to FIG. 4, in a related-art developing device 150 in which the upper end of the second conveying screw 55 is positioned above (or the same level as) the upper end of the first conveying screw 54, the second conveying screw 55 comes close to the ceiling of the casing 50 having the toner supply port 57. In the developing device 150 having such a configuration, when fresh toner particles are supplied through the toner supply port 57 in large amounts, the toner supply port 57 may be temporarily clogged with the toner particles. As a result, air cannot escape from the developing device 5 and the internal pressure of the developing device 5 may be increased. In this case, the amount of toner supplied through the toner supply port 57 to the developing device 5 may become unstable, circulation of toner within the circulation path of the developing device 5 may become unstable, and a toner image formed on the photoconductor drum 1 may be blurred or non-uniform in image density.

By contrast, in the present embodiment, since the distance NI between the ceiling of the casing 50 having the toner supply port 57 and the second conveying screw 55 is made sufficiently large, even when fresh toner particles are supplied through the toner supply port 57 in large amounts, it is less likely that the toner supply port 57 is temporarily clogged with the toner particles or that the internal pressure of the developing device 5 is increased. As a result, it is unlikely that the amount of toner supplied through the toner supply port 57 to the developing device 5 becomes unstable, circulation of toner within the circulation path of the developing device 5 becomes unstable, or an abnormal image such as blurred image and image-density-defective image is produced.

In other words, in the present embodiment, the second conveying screw 55 is disposed such that a distance between the upper end of the second conveying screw 55 and the ceiling of the casing 50 above the second conveyance path B2 is equal to or greater than a specific value. The specific value is set so that the toner supply port 57 is not clogged with toner particles even when a large amount of fresh toner particles is suppled through the toner supply port 57.

The second conveying screw 55 cannot be positioned unlimitedly lower in the height direction, and is positioned as low as possible within a range that the developing device 5 is not enlarged downward and that the circulation path formed with the first conveying screw 54 is well maintained. Also, the portion of the ceiling of the casing 50 above the second conveyance path B2 where the toner supply port 57 is formed cannot be unlimitedly higher in the height direction, and is positioned within a range that the developing device 5 is not enlarged upward and that the volume of the toner container 30 (toner storage 31) is not reduced.

In the present embodiment, as illustrated in FIG. 2, a first portion of the ceiling of the casing 50 above the first conveyance path B1 is positioned above a second portion of the ceiling of the casing 50 above the second conveyance path B2. The distance therebetween is denoted as N in FIG. 2.

Compared to the space above the second conveyance path B2, the space above the first conveyance path B1 is relatively less restrictive in layout of other members such as the toner container 30. For this reason, the first portion of the ceiling of the casing 50 above the first conveyance path B1 is positioned as high as possible in the height direction within a restricted range, in terms of layout, that the developing device 5 is not enlarged upward.

Due to this configuration, the space within the developing device 5 (first conveyance path B1) where air flows can be enlarged, thereby reducing a fluctuation of internal pressure of the developing device 5.

In the present embodiment, as illustrated in FIG. 2, a space is formed between an upper end of the partition wall 56 and the ceiling of the casing 50 facing the upper end of the partition wall 56. In other words, the partition wall 56 is disposed forming a space (encircled by dotted lines in FIG. 2) between the ceiling of the casing 50 without contacting the ceiling of the casing 50.

Due to this configuration, air flow is promoted between the first conveyance path B1 and the second conveyance path B2 via the space formed between the partition wall 56 and the ceiling of the casing 50 in the developing device 5. As a result, the internal pressure balance between the first conveyance path B1 and the second conveyance path B2 is not significantly collapsed and the internal pressure of the developing device 5 becomes uniform. Thus, a local change of toner transportability is suppressed in the circulation path.

The height of the partition wall 56 is set such that toner does not flow between the first conveyance path B1 and the second conveyance path B2 by getting over the partition wall 56. Specifically, the partition wall 56 is set higher than the upper planes of toner flows within both the first conveyance path B1 and the second conveyance path B2.

In the present embodiment, as illustrated in FIG. 3, first and second filters (toner filters) 58 and 59, each configured to collect toner and allow only air to pass through, are disposed on the ceiling of the casing 50 on a downstream side of the first conveyance path B1 and on a downstream side of the second conveyance path B2.

Specifically, a first opening is formed at the ceiling of the casing 50 on a downstream side of the first conveyance path B1, and the first filter 58 is attached to the casing 50 covering the first opening. In addition, a second opening is formed at the ceiling of the casing 50 on a downstream side of the second conveyance path B2 (above which the container-side conveying screw 61 of the toner container 30 is not disposed and an open space is formed), and the second filter 59 is attached to the casing 50 covering the second opening.

Provision of the first and second filters 58 and 59 suppresses an increase of the internal pressure of the developing device 5. In particular, the internal pressure easily increases at downstream end portions of the first conveyance path B1 and the second conveyance path B2 because air is conveyed thereto, along with toner, by the first and second conveying screws 54 and 55, respectively. As the first and second filters 58 and 59 actively release pressure, an increase of the internal pressure of the developing device 5 is effectively prevented.

Since the ceiling of the casing 50 above the second conveyance path B2 is positioned relatively higher than the second conveying screw 55 and the ceiling of the casing 50 above the first conveyance path B1 is positioned relatively higher than the first conveying screw 54, as described above, it is less likely that the first and second filters 58 and 59 are clogged with toner particles being conveyed.

Modification Example 1

Figure 5:
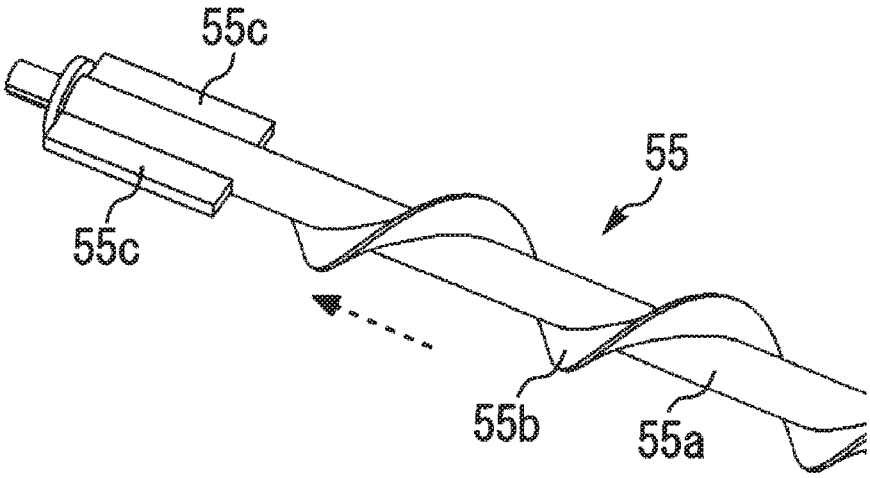
FIG. 5 is a perspective view of a downstream end portion of a second conveying screw in a conveyance direction according to Modification Example 1.

FIG. 5 is a perspective view of a downstream end portion of the second conveying screw 55 in the conveyance direction according to Modification Example 1.

Referring to FIG. 5, similar to the second conveying screw 55 according to the above-described embodiment, the second conveying screw 55 according to Modification Example 1 includes a shaft 55*a* and a screw part 55*b* spirally wound around the shaft 55*a*. As illustrated in FIG. 5, the second conveying screw 55 according to Modification Example 1 further includes a drawing part 55*c* on the downstream end portion of the shaft 55*a* in the conveyance direction. The drawing part 55*c* is configured to convey toner in such a manner that toner is drawn up in a direction substantially perpendicular to the longitudinal direction.

The drawing part 55*c* is formed to rise up from the shaft 55*a*, thus forming a paddle-like shape. As the second conveying screw 55 rotates, the drawing part 55*c* conveys toner present in the vicinity thereof in a direction substantially perpendicular to the conveyance direction indicated by dotted arrow in FIG. 5. Due to this configuration, delivery of toner from the second conveyance path B2 to the first conveyance path B1 is promoted at the second communication part A2. In the developing device 5 according to Modification Example 1, similar to the above-described embodiment, the second conveying screw 55 is positioned below the first conveying screw 54. Therefore, the second communication part A2 is inclined upward from the second conveyance path B2 toward the first conveyance path B1. Modification Example 1 is advantageous for such a configuration in which toner flows from the second conveyance path B2 toward the first conveyance path B1 while countering the inclined surface.

In Modification Example 1, the drawing part 55*c* has a paddle-like shape. According to another embodiment, the drawing part 55*c* may be formed of a flexible sheet made of PET (polyethylene terephthalate), or the screw part 55*b* wound around in a reverse direction may function as the drawing part 55*c*.

On the other hand, the first communication part A1 is inclined downward from the first conveyance path B1 toward the second conveyance path B2. Therefore, toner is smoothly delivered from the first conveyance path B1 to the second conveyance path B2 along the inclined surface.

Modification Example 2

Figure 6:
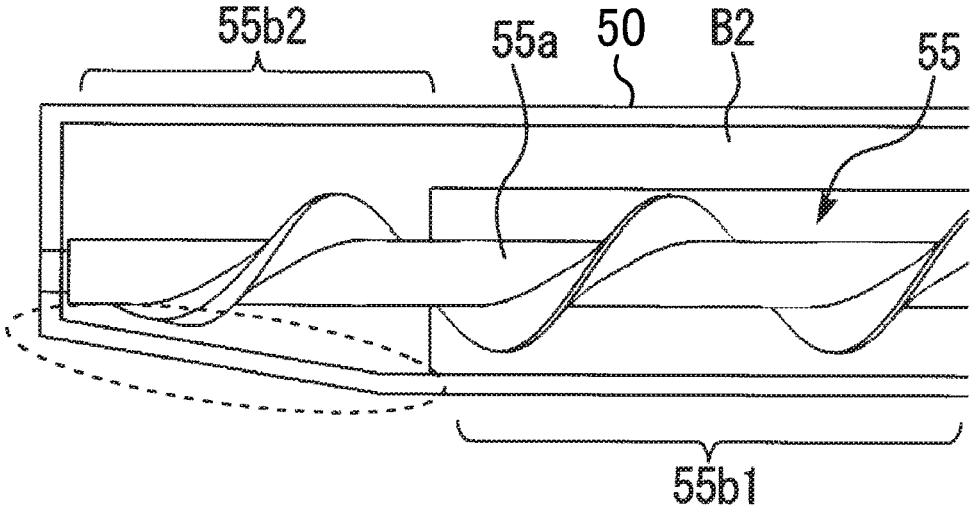
FIG. 6 is a cross-sectional view of a downstream end portion of a second conveyance path according to Modification Example 2.

FIG. 6 is a cross-sectional side view of a downstream end portion of the second conveyance path B2 according to Modification Example 2.

Referring to FIG. 6, the second conveying screw 55 according to Modification Example 2 is formed such that, at the downstream end portion thereof in the conveyance direction, the screw diameter of a screw part 55*b*2 is gradually decreased toward the downstream end in the conveyance direction. Specifically, the second conveying screw 55 is formed such that the screw diameter of the screw part 55*b*2 on the downstream end portion is gradually decreased toward the downstream end in the conveyance direction and the screw diameter of a screw part 55*b*1 on the other portion is kept constant over the conveyance direction.

In addition, referring to FIG. 6, the casing 50 of the second conveyance path B2 according to Modification Example 2 is formed such that, at the downstream end portion thereof in the conveyance direction of the second conveying screw 55, the height of the bottom of the casing 50 is gradually increased toward the downstream end in the conveyance direction, in accordance with the change in screw diameter of the screw part 55*b*2. In other words, the bottom of the casing 50 of the second conveyance path B2 at the downstream end portion (encircled by dotted lines in FIG. 6) is inclined upward from an upstream side toward a downstream side.

Due to this configuration, at the downstream end portion of the second conveyance path B2, toner moves upward along the inclined surface of the bottom while being piled up. Thus, at the second communication part A2, toner can be more easily delivered from the second conveyance path B2 to the first conveyance path B1 while countering the inclined surface.

Modification Example 3

Figure 7:
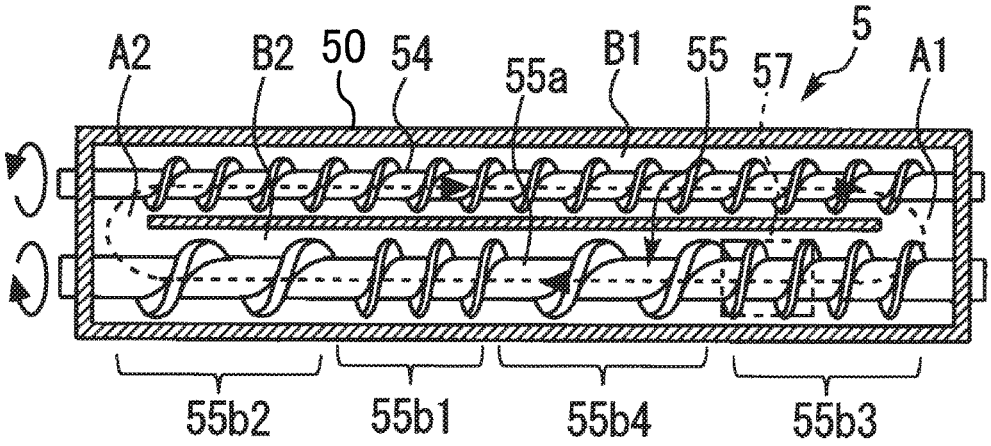
FIG. 7 is a top view of a circulation path, in a longitudinal direction, formed in a developing device according to Modification Example 3.
Figure 8:
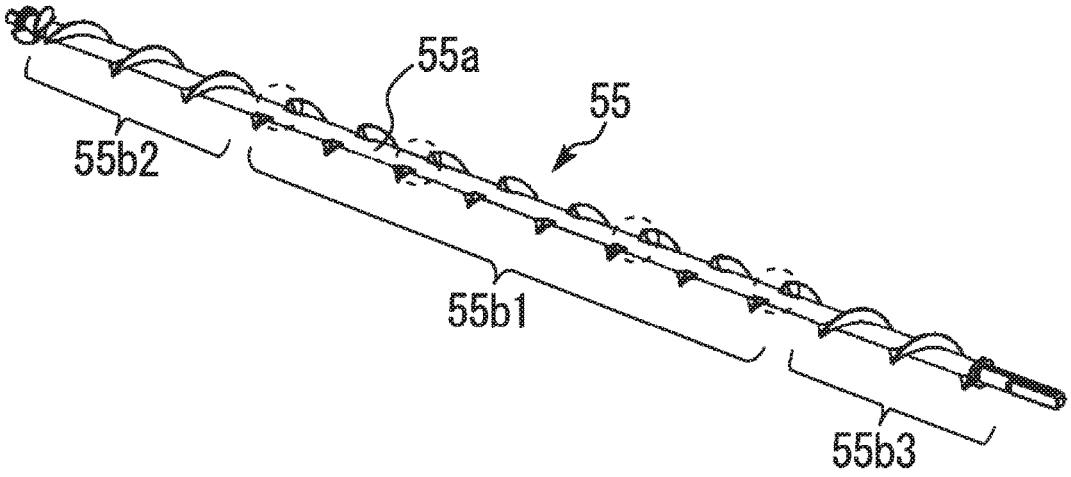
FIG. 8 is a perspective view of a second conveying screw according to another embodiment of the present invention.

FIG. 7 is a top view of the circulation path, in a longitudinal direction, formed in the developing device 5 according to Modification Example 3, corresponding to FIG. 3 illustrating the circulation path according to the above-described embodiment. FIG. 8 is a perspective view of the second conveying screw 55 according to another embodiment.

The second conveying screw 55 according to Modification Example 3 conveys the toner downstream of the toner supply port 57 in the conveyance direction faster than upstream thereof.

Specifically, as illustrated in FIG. 7, the second conveying screw 55 according to Modification Example 3 is formed such that the screw pitch of a screw part 55*b*4 on a downstream side of the toner supply port 57 in the conveyance direction is greater than the screw pitch of a screw part 55*b*3 on an upstream side of the toner supply port 57 in the conveyance direction. Due to this configuration, toner supplied to the inside of the developing device 5 (second conveyance path B2) through the toner supply port 57 is rapidly conveyed downstream by the screw part 55*b*4, disposed on a downstream side of the toner supply port 57, without being stagnated at that position. Thus, the occurrence of toner clogging at the toner supply port 57 is more suppressed.

In addition, the second conveying screw 55 according to Modification Example 3 conveys the toner at the downstream end portion thereof in the conveyance direction faster than at the central portion thereof in the conveyance direction.

Specifically, as illustrated in FIG. 7, the second conveying screw 55 according to Modification Example 3 is formed such that the screw pitch of the screw part 55*b*2 at the downstream end potion is greater than the screw pitch of the screw part 55*b*1 at the central portion. Due, to this configuration, toner is easily stagnated and piled up at the downstream end potion of the second conveyance path B2. Thus, at the second communication part A2, toner is more easily delivered from the second conveyance path B2 to the first conveyance path B1 while countering the inclined surface.

The toner conveying speed of the second conveying screw 55 can be varied by position in the conveyance direction by varying at least one of the screw pitch of the screw part 55*b*, the screw diameter of the screw part 55*b*, and the amount of cutout formed on the screw part 55*b*. In Modification Example 3, the toner conveying speed is varied by position in the conveyance direction by varying the screw pitch of the screw part 55*b* by position in the conveyance direction. Alternatively, the toner conveying speed may be varied by position in the conveyance direction by varying the screw diameter of the screw part 55*b* by position in the conveyance direction. In particular, the toner conveying speed at a position where the screw diameter is large is greater than that at a position where the screw diameter is small.

As illustrated in FIG. 8, the toner conveying speed may also be varied by position in the conveyance direction by varying the amount of cutout formed on the screw part 55*b* by position in the conveyance direction. In the embodiment illustrated in FIG. 8, no cutout is formed (i.e., the amount of cutout is zero) on each of the screw part 55*b*2 on the downstream end portion and the screw part 55*b*3 on the upstream end portion, while several cutouts (in an amount equal to about ⅙ of the circumference length) are formed on the screw part 55*b*1 on the central portion. As a result, the toner conveying speed of each of the screw part 55*b*2 on the downstream end portion and the screw part 55*b*3 on the upstream end portion, each having a small amount of cutout, is greater than the toner conveying speed of the screw part 55*b*1 on the central portion having a large amount of cutout.

The developing device 5 according to an embodiment of the present invention includes, as described above, the developing roller 51, the supply roller 53, the first conveying screw 54 disposed above the supply roller 53, and the second conveying screw 55 forming a toner circulation path along with the first conveying screw 54. The toner supply port 57 is formed at the ceiling of the casing 50 above the second conveyance path B2 formed by the second conveying screw 55, through which toner is supplied to the inside of the developing device 5. The upper end of the second conveying screw 55 is positioned below the upper end of the first conveying screw 54.

Due to this configuration, it is unlikely that the internal pressure of the developing device 5 increases, the amount of toner supplied through the toner supply port 57 to the inside of the developing device 5 becomes unstable, and circulation of toner within the circulation path of the developing device 5 becomes unstable.

In the above-described embodiments, the developing device 5 is integrated with the photoconductor drum 1 (image bearer), the charging roller 4, and the cleaner 2, to be configured as the process cartridge 6. However, the configuration of the developing device 5 is not limited thereto. Embodiments of the present invention further provide the developing device 5 configured as a single unit detachably mountable on the image forming apparatus 100. In either embodiment, the same effect can be obtained.

In the present disclosure, a "process cartridge" refers to a unit that integrally combines an image bearer with at least one of a charger for charging the image bearer, a developing device for developing a latent image formed on the image bearer, and a cleaner for cleaning the image bearer, and is detachably mountable on an image forming apparatus body.

In the above-described embodiments, the developing device 5 employs a contact one-component developing method and is configured such that the developing roller 51 is in contact with the photoconductor drum 1 without forming a gap therebetween. Embodiments of the present invention further provide another type of developing device employing a non-contact one-component developing method, configured such that a developing roller is facing a photoconductor drum forming a gap therebetween.

In the above-described embodiments, the outer diameter (screw diameter) of the second conveying screw 55 is greater than the outer diameter (screw diameter) of the first conveying screw 54. Alternatively, the outer diameter of the second conveying screw 55 may be smaller than the outer diameter of the first conveying screw 54, or the outer diameters of the first and second conveying screws 54 and 55 may be the same.

In either embodiment, the same effect can be obtained.

In the above-described embodiments, the single-color image forming apparatus 100 is provided including only one image forming unit (process cartridge 6) in which a toner image is transferred onto a sheet P. Embodiments of the present invention further provide a multi-color image forming apparatus including multiple image forming units in each of which a toner image is primarily transferred onto an intermediate transferor, such as an intermediate transfer belt, and secondarily transferred from the intermediate transferor onto a sheet.

In either embodiment, the same effect can be obtained.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A developing device for developing a latent image formed on a surface of an image bearer into a toner image, comprising:

a developing roller in contact with or facing the image bearer;

a supply roller configured to supply toner to the developing roller;

a casing;

a first conveyer disposed within the casing and above the supply roller, the first conveyer configured to supply toner stored in the developing device to the supply roller, the first conveyer forming a first conveyance path;

a second conveyer disposed within the casing with an upper end thereof positioned below an upper end of the first conveyer, the second conveyer forming a second conveyance path forming a toner circulation path together with the first conveyance path;

a partition wall separating the first conveyance path and the second conveyance path in a longitudinal direction within a range excluding both longitudinal end portions; and a toner supply port above a rotational center of the second conveyor and disposed at a ceiling of the casing above the second conveyance path, through which toner is supplied to an inside of the developing device.

2. The developing device of claim 1, wherein a distance between the upper end of the second conveyer and the ceiling of the casing above the second conveyance path is equal to or greater than a specific value.

3. The developing device of claim 1, wherein a first portion of the ceiling of the casing above the first conveyance path is positioned above a second portion of the ceiling of the casing above the second conveyance path.

4. The developing device of claim 1, wherein a space is formed between an uppermost end of the partition wall and the ceiling of the casing.

5. The developing device of claim 1, further comprising:

two filters each configured to collect toner and allow air to pass though, disposed on the ceiling of the casing on a downstream side of the first conveyance path and on a downstream side of the second conveyance path.

6. The developing device of claim 1, wherein the second conveyer is a conveying screw including:

a shaft;

a screw part spirally wound around the shaft; and a drawing part disposed on a downstream end portion of the shaft in a conveyance direction, the drawing part configured to draw up toner in a direction substantially perpendicular to the longitudinal direction.

7. The developing device of claim 1, wherein the second conveyer is a conveying screw including:

a shaft; and a screw part spirally wound around the shaft, wherein a screw diameter of the screw part, at a downstream end portion in a conveyance direction, gradually decreases toward a downstream end in the conveyance direction, wherein a height of a bottom of the casing, at the downstream end portion in the conveyance direction, gradually increases toward the downstream end in the conveyance direction, in accordance with a change in the screw diameter of the screw part at the downstream end portion in the conveyance direction.

8. The developing device of claim 1, wherein the second conveyer conveys the toner downstream of the toner supply port in a conveyance direction faster than upstream thereof.

9. The developing device of claim 1, wherein the second conveyer conveys the toner at a downstream end portion in a conveyance direction faster than at a central portion in the conveyance direction.

10. The developing device of claim 8, wherein the second conveyer is a conveying screw including:

a shaft; and a screw part spirally wound around the shaft, wherein at least one of a screw pitch of the screw part, a screw diameter of the screw part, and an amount of cutout formed on the screw part is varied by position in the conveyance direction to vary a toner conveying speed by position in the conveyance direction.

11. The developing device of claim 1, wherein the toner supply port is disposed upstream of the second conveyance path.

12. A process cartridge detachably mountable on an image forming apparatus, comprising:

an image bearer; and the developing device of claim 1.

13. An image forming apparatus comprising:

an image bearer; and the developing device of claim 1.

* * * * *